US006705875B2

(12) United States Patent
Berghorn et al.

(10) Patent No.: US 6,705,875 B2
(45) Date of Patent: Mar. 16, 2004

(54) COAXIAL PLUG MEMBER

(75) Inventors: Manfred Berghorn, Stolzenau (DE); Günter Pape, Enger (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 10/107,101

(22) Filed: Mar. 25, 2002

(65) Prior Publication Data

US 2002/0142625 A1 Oct. 3, 2002

(30) Foreign Application Priority Data

Mar. 29, 2001 (DE) ..... 101 15 479

(51) Int. Cl.[7] ..... H01R 12/00
(52) U.S. Cl. ..... 439/63; 439/578; 439/252
(58) Field of Search ..... 439/6, 8, 63, 246, 439/247, 252, 578

(56) References Cited

U.S. PATENT DOCUMENTS 2,999,998 A * 9/1961 Cole ..... 439/252
4,580,862 A 4/1986 Johnson
4,865,558 A * 9/1989 Stoner ..... 439/246
4,995,836 A 2/1991 Toramoto
5,217,391 A * 6/1993 Fisher, Jr. ..... 439/578
5,516,303 A 5/1996 Yohn et al.
5,769,652 A 6/1998 Wider
6,312,287 B1 * 11/2001 Harting et al. ..... 439/581
6,530,787 B2 * 3/2003 Harting et al. ..... 439/83
6,558,177 B2 * 5/2003 Havener et al. ..... 439/246

FOREIGN PATENT DOCUMENTS

| | | | |
|---|---|---|---|
| DE | 29517358 U1 | 2/1996 | ..... H01R/13/627 |
| DE | 19927713 C1 | 1/2001 | ..... H01R/24/02 |
| DE | 19942579 A1 | 3/2001 | ..... H01R/12/32 |
| EP | 1028495 | 8/2000 | |
| WO | WO 00/52788 | 9/2000 | ..... H01R/13/631 |

* cited by examiner

*Primary Examiner*—Tho D. Ta
*Assistant Examiner*—James R. Harvey
(74) *Attorney, Agent, or Firm*—Hayes Soloway P.C.

(57) ABSTRACT

A coaxial plug member comprises a housing, an inner contact, an outer contact and an insulating piece which is arranged between the inner and outer contacts. The outer contact is pivotally attached to the housing, as a result of which also the insulating piece received in the outer contact and the inner contact received in the insulating piece are able to pivot as a unit.

7 Claims, 3 Drawing Sheets

COAXIAL PLUG MEMBER

TECHNICAL FIELD

The invention relates to a coaxial plug member comprising a housing, an inner contact, an outer contact and an insulating piece which is arranged between the inner and outer contacts.

BACKGROUND OF THE INVENTION

In the event that such a plug member is plugged into a complementary plug member in order to establish a plug connection, there exists the danger that the two plug members are dislocated or turned in relation to a centered arrangement where the two middle axes of the plug members are coincident. In the case of such a misalignment, undesirably high loads are possibly exerted on the plug contacts. These loads are transferred, to some extent via the housing and to some extent in direct way, to the component to which the plug member is attached. If the contacts have been soldered with the components, in particular in SMT technology, there exists the danger that the loads acting on the soldering spot lead to a damaging of the soldering spots.

From WO 00/52788 there is known an adapter which serves for connecting two circuit boards, in particular in the field of RF engineering. A base member is mounted on one of the circuit boards, this base member being provided with a ball-shaped head. An insulating piece provided with an inner conductor and an outer conductor is pivotally attached to the ball-shaped member. The insulating piece can be plugged into a complementary base member which is mounted on the other circuit board. Due to the pivoting arrangement of the insulating piece, it is possible to compensate for a lateral offset between the two circuit boards. By plugging the insulating piece into the complementary base member at differing depths, deviations in the distance between the two circuit boards can be compensated for. The known adapter, however, does not concern a plug member, but a coaxial connection which serves for a permanent connection between two circuit boards in a stack of circuit boards. Moreover, the structural expenditure is comparably high, because with the articulated attachment of the insulating piece, making contact with the inner and outer conductors is very complicated.

BRIEF SUMMARY OF THE INVENTION

It is the object of the invention to further develop a coaxial plug member of the type initially mentioned to the extent that with low structural expenditure the contacts are subjected to lower loads, if it happens that the plug member is inserted into a complementary plug member with a misalignment being present. According to the invention, a coaxial plug member is provided which comprises a housing, an inner contact, an outer contact and an insulating piece which is arranged between the inner and outer contacts. The outer contact is pivotally attached to the housing, as a result of which also the insulating piece received in the outer contact and the inner contact received in the insulating piece are able to pivot as a unit. In this way there results a particularly simple construction, because solely one single component has to be pivotally attached to the housing, namely the outer contact. Nevertheless, on plugging in of the complementary plug connector, the contact unit consisting of the inner and outer contacts and of the insulating piece is able to automatically self-align corresponding to the misalignment of the two plug members, so that the middle axes of the contacts to be plugged into each other are coincident again. The contacts of the two plug members can then easily be pushed into each other, without excessive loads occurring.

According to the preferred embodiment it is provided for that the inner contact is provided with a ball-shaped head onto which a spring clip is slipped which can be connected with a circuit board by means of SMT technology. Using a ball-shaped head results in a connection between the inner contact and the spring clip in the nature of a ball joint, so that the contact unit is able to move relative to the spring clip without a movement being transferred to the spring clip. Thereby it is ensured that the SMT soldering spot, by means of which the spring clip can be connected with the circuit board, is not exposed to loads. The contribution of the ball joint-like connection between the inner contact and the spring clip, for pivotally arranging the contact unit, can be neglected.

Preferably it is provided for that the ball-shaped head is approximately coincident with the center of motion of the contact unit in the housing. Thereby it is ensured that no translatory motion occurs between spring clip and inner contact, if the unit of inner contact, outer contact and insulating piece is swiveled relative to the housing; there will merely occur a rotation by few degrees.

Advantageous designs of the invention will be apparent from the sub-claims.

DETAILED DESCRIPTION OF THE PREFERRED EMBODIMENT

Figure 1:
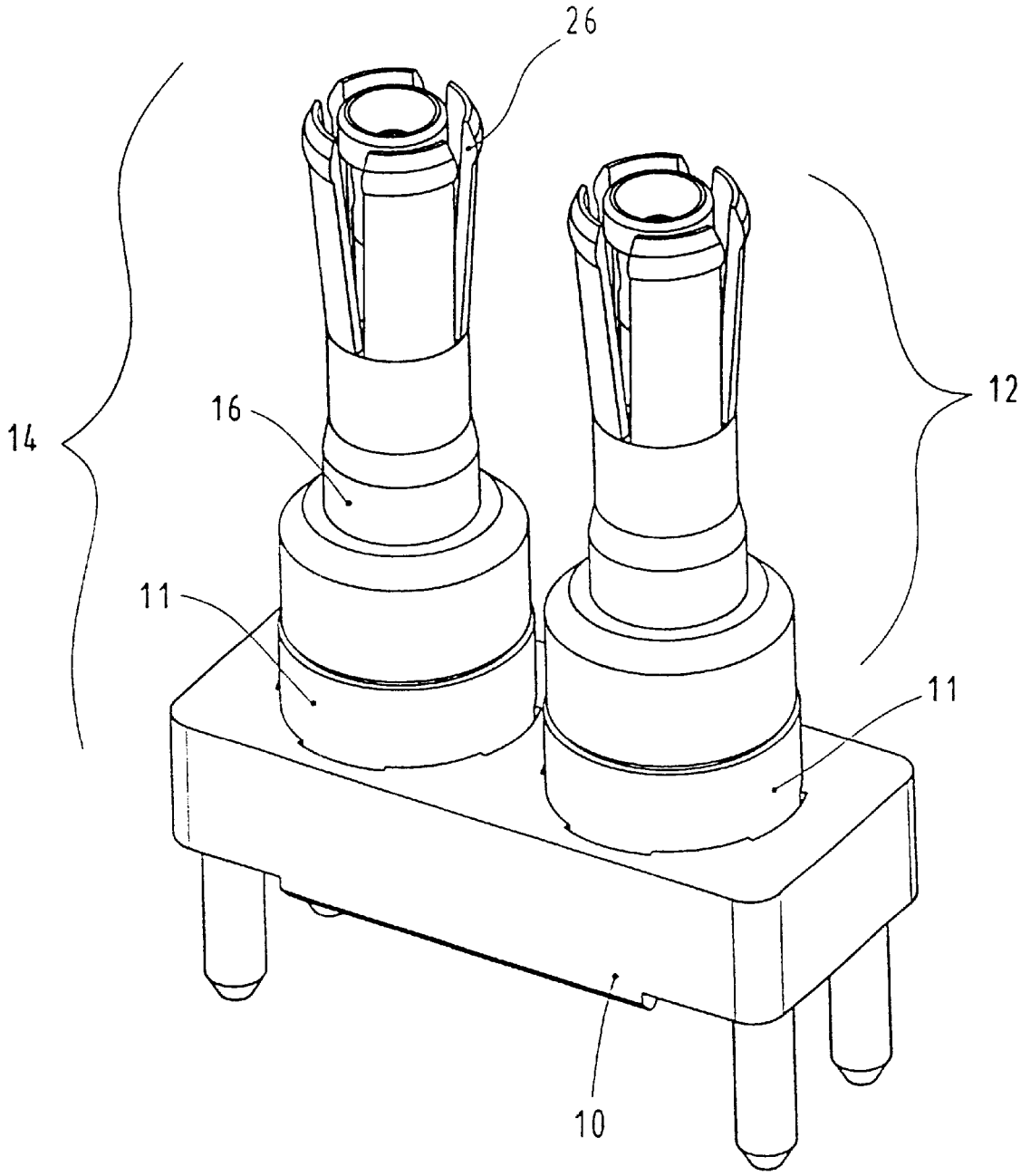
FIG. 1 shows in a perspective view a coaxial plug member according to the invention.
Figure 2:
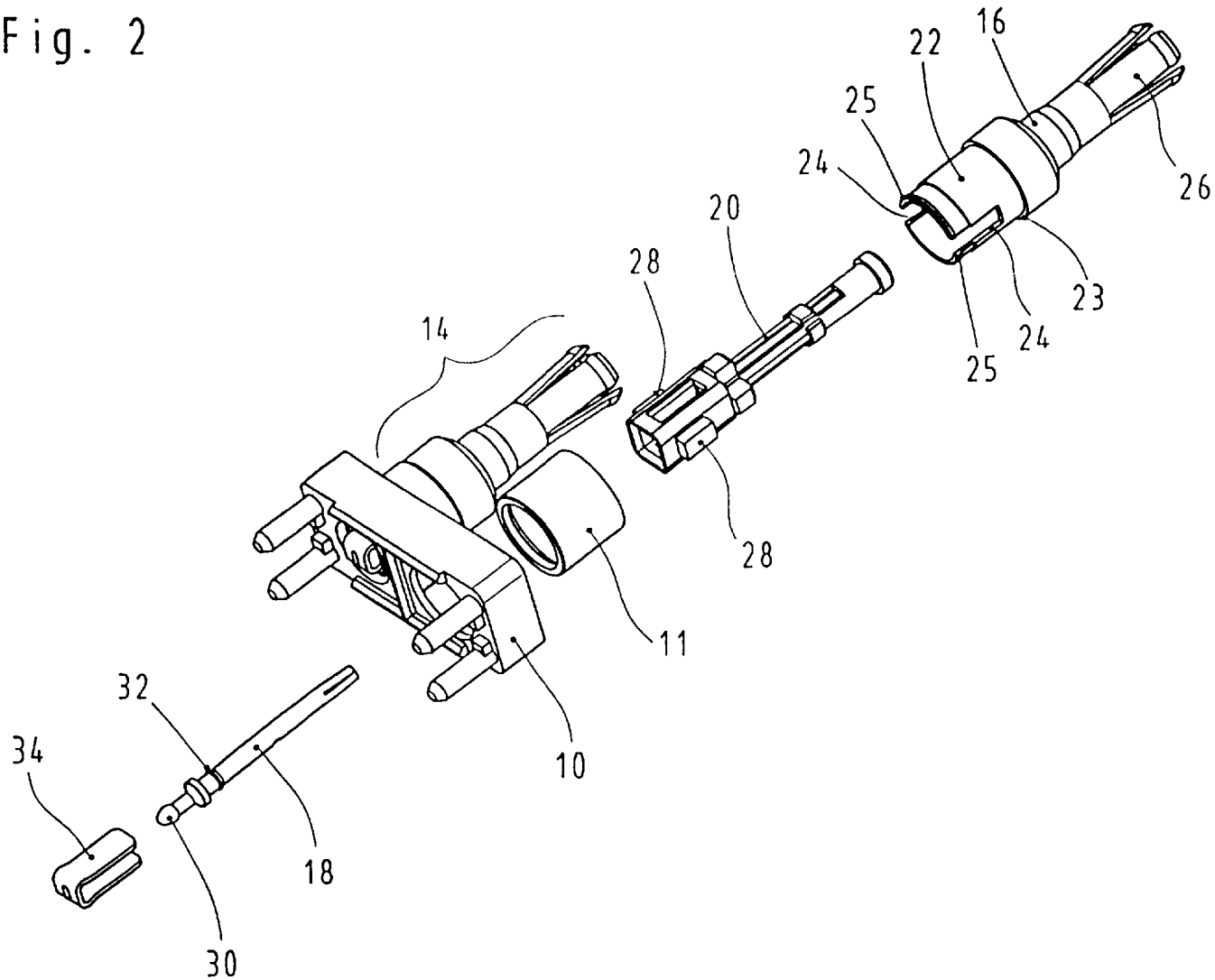
FIG. 2 shows in a perspective, exploded view the coaxial plug member of FIG. 1.

In FIGS. 1 and 2 there is shown a coaxial plug member which as the most important components has a housing 10 as well as two contact units 12, 14 that are attached to the housing 10. Each contact unit is constituted by an outer contact 16, an inner contact 18 and an insulating piece 20.

The housing 10 consists of an electrically insulating material, for example plastics, and has two openings for receiving the contact units. Associated with the openings is one retention ring 11 each, the function of which will be explained below.

The outer contact 16 consists of an electrically conductive material and has at its end associated with the housing 10 a sleeve-shaped skirt 22 which is provided with two recesses 24. The free end of the skirt 22 is provided with a surrounding projection which is interrupted by the two recesses 24, so that the free end forms two latching hooks 25. A shoulder 23 is provided at the transition of the skirt 22 to the body of the outer contact 16. On the opposite end, the outer contact is provided with a plurality of elastic tongues 26.

The insulating piece 20 consists of an electrically insulating material and is provided with two oppositely arranged protrusions 28, the dimensions of which are chosen such that they are able to be slipped into the recesses 24 of the outer contact 16. The inner contact 18 consists of an electrically conductive material and in this arrangement is configured as a sleeve, the one end of which is provided with a slot and the other end of which is provided with a ball-shaped head 30. The inner contact 18 is further provided with a latching collar 32.

Associated with the inner contact 18 is a spring clip 34 which is given a U-shape. The two oppositely arranged legs of the spring clip 34 are provided for elastically engaging the ball-shaped head 30 of the inner contact. The web connecting the two legs of the spring clip with each other is provided for to be connected with an electrically conductive surface area by means of SMT technology.

The coaxial plug member is assembled in the following way: First, the retention ring 11 is fixed in the housing 10. The end face, lying within the housing, of the retention ring 11 then forms an undercut which could be manufactured only with great difficulty in the case of a one-piece design of the housing 10. Next, the insulating piece 20 is pushed into the outer contact 16 such that the protrusions 28 engage in the recesses 24. The outer contact 16 complete with the insulating piece 20 is then pushed into the retention ring 11, with the latching hooks 25 snapping in place behind the end face of the retention ring 11. The distance between the latching hooks 25 and the shoulder 23 of the outer contact 16 is larger than the length of the retention ring 11, so that a defined play is present in axial direction. Furthermore, the inner diameter of the retention ring 11 is larger than the outer diameter of the skirt 22, so that a defined play is present in radial direction, too.

The inner contact 18 is inserted in the insulating piece 20, mounted in the housing 10, from the other side than are the insulating piece and the outer contact 16, as is shown in FIG. 2. In so doing, the latching collar 32 of the inner contact 18 latches in place in the interior of the insulating piece 20, so that the inner contact is firmly received. Finally, the spring clip 34 is slipped onto the ball-shaped head 30 of the inner contact 18. With this, assembly of the coaxial plug member is completed. The important feature lies in that the pivoting arrangement of the contact unit on the housing is substantially established by the outer contact 16 only. The ability to pivot results from the radial and axial play between the retention ring 11 and the skirt 22 in the housing.

Figure 3:
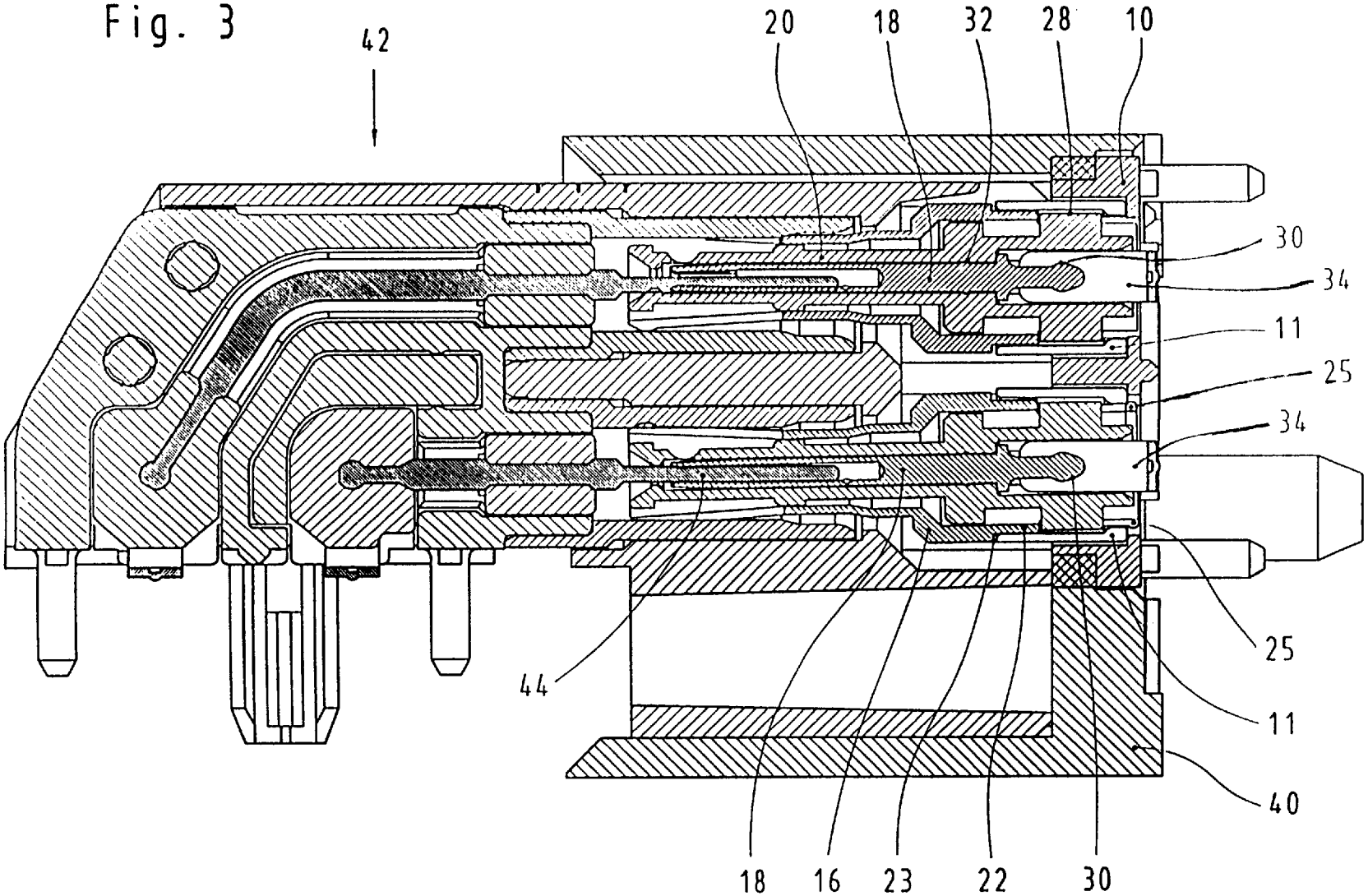
FIG. 3 shows in a sectional view the coaxial plug member of FIG. 1 together with a complementary plug member.

FIG. 3 shows the assembled coaxial plug member which in this arrangement is mounted in a receiving part 40. There is further shown a complementary plug member 42 which is plugged into the assembled coaxial plug member. The complementary plug member has pin-shaped contacts 44 which are pushed into the inner contacts 18 of the coaxial plug member. It is clearly to be seen at the lower outer contact 16 of FIG. 3 how the latter is obliquely accommodated in the housing 10 and in the retention ring 11: The distance between the left-hand end face of the retention ring 11 and the shoulder 23 is on the lower side much smaller than on the upper side, because the outer contact 16 together with the insulating piece 20 and the inner contact 18 is rotated relative to the housing 10 in anti-clockwise direction. Such pivoting motion of the contact unit occurs around a center of motion which is approximately coincident with the center of the ball-shaped head 30 of the inner contact 18. This is why merely a rotational movement occurs between the spring clip 34 and the ball-shaped head 30 when the unit made up of outer contact 16, inner contact 18 and insulating piece 20 adapts to an obliquely inserted complementary plug member. In spite of the frictional forces between the ball-shaped head 30 and the spring clip 34 and due to the large distance between the free front end of the contact units 12, 14 and the center of motion on the ball-shaped member 30, this rotational movement can be achieved with low forces, as the forces acting have a large lever arm. These forces required are significantly smaller than those necessary for a translational movement between ball-shaped head and spring clip, because a translational movement does not benefit from a long lever arm.

What is claimed is:

1. A coaxial plug member comprising a housing, an inner contact, an outer contact and an insulating piece which is arranged between said inner and outer contacts, said outer contact being pivotally attached to said housing, as a result of which also said insulating piece received in said outer contact and said inner contact received in said insulating piece are able to pivot as a unit, wherein:

(a) said outer contact is provided with a plurality of latching hooks which latch in place on said housing, so that said contact unit consisting of said inner and outer contacts and of said insulating piece is able to pivot;

(b) said housing has a retention ring behind which said latching hooks latch in place; and (c) said insulating piece is provided with two protrusions and said outer contact with two recesses and wherein said two protrusions are held in said two recesses by means of said retention ring.

2. A coaxial plug member comprising a housing, an inner contact, an outer contact and an insulating piece which is arranged between said inner and outer contacts, said outer contact being pivotally attached to said housing, as a result of which also said insulating piece received in said outer contact and said inner contact received in said insulating piece are able to pivot as a unit, wherein said inner contact is provided with a ball-shaped head onto which a spring clip is slipped which can be connected with a circuit board by means of SMT technology.

3. The coaxial plug member according to claim 1, wherein said outer contact together with said insulating piece is inserted into said housing from one side and said inner contact is inserted into said insulating piece from an opposite side.

4. The coaxial plug member according to claim 1, wherein said inner contact is latched in place in said insulating piece.

5. The coaxial plug member according to claim 1, wherein said inner contact is provided with a ball-shaped head onto which a spring clip is slipped which can be connected with a circuit board by means of SMT technology.

6. The coaxial plug member according to claim 5, wherein said ball-shaped head is approximately coincident with a center of motion of said contact unit in said housing.

7. The coaxial plug member according to claim 2, wherein said ball-shaped head is approximately coincident with a center of motion of said contact unit in said housing.

* * * * *